US007871577B2

(12) United States Patent
Allam et al.

(10) Patent No.: US 7,871,577 B2
(45) Date of Patent: Jan. 18, 2011

(54) PROCESS AND APPARATUS FOR THE PRODUCTION OF HYDROCARBON COMPOUNDS FROM METHANE

(75) Inventors: Rodney Allam, Guildford (GB); Andrew Weaver, Walton-on-Thames (GB); Vincent White, Epsom (GB); David B. Byard, Woking (GB)

(73) Assignee: GTLpetrol LLC, New York, NY (US)

( * ) Notice: Subject to any disclaimer, the term of this patent is extended or adjusted under 35 U.S.C. 154(b) by 0 days.

(21) Appl. No.: 10/524,325

(22) PCT Filed: Aug. 6, 2003

(86) PCT No.: PCT/GB03/03403

§ 371 (c)(1),
(2), (4) Date: Sep. 1, 2005

(87) PCT Pub. No.: WO2004/015028

PCT Pub. Date: Feb. 19, 2004

(65) Prior Publication Data

US 2006/0074132 A1 Apr. 6, 2006

(30) Foreign Application Priority Data

Aug. 13, 2002 (GB) ..... 0218815.9

(51) Int. Cl.
*B01J 8/00* (2006.01)
*F25J 3/00* (2006.01)

(52) U.S. Cl. ..... 422/189; 422/234; 422/235; 422/187; 62/617

(58) Field of Classification Search ..... 62/920
See application file for complete search history.

(56) References Cited

U.S. PATENT DOCUMENTS 4,044,063 A * 8/1977 Ireland et al. ..... 208/79

(Continued)

FOREIGN PATENT DOCUMENTS

EP 1278036 A1 1/2003

OTHER PUBLICATIONS

Davis et al. "Cryogenics for Syngas Processing." Feb. 1980. Chemical Engineering Progress, pp. 72-79.*

(Continued)

*Primary Examiner*—Jennifer A Leung
(74) *Attorney, Agent, or Firm*—Fish & Richardson P.C.

(57) ABSTRACT

Higher molecular weight hydrocarbon compounds or oxygenates are produced from a gas comprising methane in a process comprising the steps of generating synthesis gas ("syngas") comprising carbon monoxide and hydrogen by reaction of a gas comprising methane with steam and/or an oxidant gas comprising oxygen, producing higher molecular weight hydrocarbon compounds or oxygenates in a syngas conversion process, removing offgas comprising unreacted hydrogen and unreacted carbon monoxide from said syngas conversion process and separating cryogenically unreacted hydrogen from said offgas or from a gas derived therefrom to produce separated hydrogen product that is substantially free of unreacted carbon monoxide and a first cryogenic liquid comprising unreacted carbon monoxide. The unreacted hydrogen is preferably separated from the offgas in a liquid methane wash column. Two advantages of this process are that this cryogenic separation process is more efficient than known pressure swing absorption techniques and that the concentration of carbon monoxide in the separated hydrogen product is sufficiently small that the separated hydrogen product may be used in the hydrogenation of a wax fraction of the higher molecular weight hydrocarbon compounds without further purification or processing.

7 Claims, 3 Drawing Sheets

U.S. PATENT DOCUMENTS

| | | | | | |
|---|---|---|---|---|---|
| 4,102,659 | A | * | 7/1978 | Martin | 62/625 |
| 4,217,759 | A | | 8/1980 | Shenoy | |
| 4,252,736 | A | | 2/1981 | Haag et al. | |
| 4,650,814 | A | * | 3/1987 | Keller | 518/703 |
| 4,782,096 | A | | 11/1988 | Banquy | |
| 4,888,130 | A | * | 12/1989 | Banquy | 252/373 |
| 5,132,007 | A | | 7/1992 | Meyer et al. | |
| 5,173,513 | A | | 12/1992 | Pinto | |
| 5,496,859 | A | * | 3/1996 | Fong et al. | 518/703 |
| 6,073,461 | A | * | 6/2000 | McNeil et al. | 62/625 |
| 6,098,424 | A | | 8/2000 | Gallarda et al. | |

OTHER PUBLICATIONS

Perry's Chemical Engineers' Handbook, 7th Edition. 1997. pp. 27-25 to 27-28.*

International Search report issued in International Application No. PCT/GB03/03403 on Nov. 28, 2003, 4 pages.

International Preliminary Examination Report issued in International Application No. PCT/GB03/03403 on Dec. 9, 2004, 6 pages.

Examination Report issued in Austrian Application No. GCC/P/2003/2836 on Feb. 22, 2008, 6 pages.

Search Report issued in GB Application No. GB 0218815.9 on Apr. 28, 2003, 2 pages.

* cited by examiner

PROCESS AND APPARATUS FOR THE PRODUCTION OF HYDROCARBON COMPOUNDS FROM METHANE

The present invention relates to a process and apparatus for the production of hydrocarbon compounds or oxygenates from a gas comprising methane such as natural gas. In particular, the invention relates to the separation of components present in offgas produced by the process.

Natural gas may be found in remote locations both on- and off-shore. It is generally expensive to transport natural gas from a remote source to a distant market by building a pipeline. One solution is to liquefy the natural gas and transport the liquid by ship to the market place. Another solution is to convert the gas on-site to a valuable and easily transportable product. In this way, the value of the natural gas may be increased.

Natural gas may be converted to synthesis gas ("syngas") which is a mixture of carbon monoxide and hydrogen. Syngas can be produced in a number of different ways, including steam-hydrocarbon reforming, partial oxidation using pure oxygen, air or air enriched with pure oxygen, or autothermal reforming using a catalyst bed following a partial oxidation burner. In all of these processes, the syngas is produced at a high temperature, for example, typically 1300° C. to 1400° C. for partial oxidation, typically 800° C. to 900° C. for steam-natural gas reforming and typically from 950° C. to 1050° C. for autothermal reforming. Optionally, carbon dioxide can be added to the reacting gas mixture to adjust the ratio of hydrogen to carbon monoxide in the syngas.

Syngas can also be produced in a two-step process, the first step involving exothermic reaction of natural gas with oxygen and the second step involving endothermic reforming of steam and natural gas. The heat present in the syngas from the first step may be used to produce additional syngas in the second step and reduce the production of excess steam giving higher overall efficiency. Syngas is produced by both steps and the syngas products may be combined. Heat from the first step is used to drive the second endothermic step known as a heat exchange reforming ("HER") reaction. The first step can take place in a partial oxidation ("POX") reactor, an autothermal reformer ("ATR") or a catalytic partial oxidation ("CPO") reactor and the second step usually takes place in a heat transfer reformer such as an enhanced heat transfer reformer ("EHTR").

Syngas can be separated into hydrogen-rich and carbon monoxide rich products using cryogenic techniques such as methane wash and partial condensation. Examples of such separation processes are disclosed in EP-A-1278036 (Scharpf; published on 22 Jan. 2003), U.S. Pat. No. 4,217,759 (Shenoy; published on 19 Aug. 1980) and U.S. Pat. No. 6,098,424 (Galladra et al; published on 8 Aug. 2000).

An example of an HER process is disclosed in U.S. Ser. No. 10/083,778 (filed on 25 Feb. 2002, now abandoned) and this disclosure is incorporated herein by reference. It is disclosed generally that a cooling stream of reactive diluent fluid may be introduced to a stream of fresh syngas produced in a primary heat-generating unit to produce a cooled mixture of syngas and reactive diluent fluid. The subsequent reaction of at least two of the components of the mixture will either produce further carbon monoxide or gasify solid carbon particles. In particular, in this disclosure hydrocarbon-containing fuel is exothermically reacted with an oxidant gas comprising molecular oxygen in a first reactor to produce an exothermically-generated syngas product. A stream of reactive diluent fluid is combined with a stream of said exothermically-generated syngas product to produce a reactive mixture and the reactive mixture is reacted in a second reactor to produce a reacted syngas product if desired, this reacted syngas may be introduced into the secondary reforming unit in an HER process. The reacted syngas product is cooled before being introduced into the secondary unit thereby avoiding negatively affecting the mechanical integrity of the secondary unit. In the exemplified embodiment, a POX reactor is used in combination with an EHTR.

Syngas may be converted into oxygenates such as methanol, oxo-alcohols or DME. Syngas may also be converted into hydrocarbon compounds by, for example, a Fischer-Tropsch ("FT") process producing solid or liquid synthetic fuels ("synfuels"). Conversion products are generally liquids which have less volume per unit mass (i.e. have a greater density) than the natural gas. Accordingly, it is more economical to transport conversion products than a corresponding amount of natural gas.

In the FT process, carbon monoxide and hydrogen are converted exothermically into a mixture of hydrocarbon compounds (having a range of different molecular weights) and water according to the following equation:

$$CO+2H_2 \rightarrow —CH_2— + H_2O$$

The $—CH_2—$ groups combine to form hydrocarbon chains giving valuable liquids and waxes.

The FT apparatus may comprise one or more FT reactors in series containing a catalyst system, together with a means for transferring the exothermic reaction heat to a suitable circulating medium such as water thereby producing steam. The economics of the apparatus, together with the activity of the catalyst, dictate the degree of conversion of the inlet syngas. Typically, up to 30% of the syngas can remain unconverted after passing through a typical two-stage reactor system with each stage being followed by a cooler and water plus hydrocarbon separator. The overall economics of the process would be improved if as much as possible of the unconverted syngas is recycled to the FT reactor inlet.

In common with all reaction systems in which a gas is recycled, there is a problem of how to deal with the small concentrations of impurities, inert or otherwise, present in the fresh syngas feed or produced by the reaction process itself. For example, where the syngas mixture may be produced by a partial oxidation step of some kind, these impurities may include argon (from the oxygen feed), nitrogen (from the oxygen feed and/or the natural gas feed), helium (from the natural gas feed), methane (produced in the FT reactor or from unconverted natural gas) and/or carbon dioxide (produced during syngas generation and in the FT reactor). A feed-gas produced from a steam-natural gas reformer with recycled carbon dioxide may still have, in general, inert nitrogen, helium, methane and carbon dioxide in the unconverted gas leaving the FT reactor system.

Offgas from a syngas generation and FT reaction system may comprise hydrogen, carbon monoxide, methane, argon, helium, nitrogen, carbon dioxide, water and lower molecular weight hydrocarbons, e.g. $C_2$ to $C_6$ hydrocarbons. Consequently, in order to ensure maximum recovery of valuable hydrogen and carbon monoxide, it is desirable to devise a separation process that can be used to remove any or all of these impurities from the offgas with minimal loss of hydrogen and carbon monoxide.

Previous efforts to separate and recycle hydrogen and carbon monoxide have been hampered by the lack of a suitable means of separating carbon monoxide from nitrogen and argon. Hydrogen can be separated in a pressure swing adsorption ("PSA") process using a multiple bed switching system, but this cannot economically separate both the hydrogen and carbon monoxide from the argon, nitrogen and methane. Because of this difficulty, it has become common practice (Bectel reference—U.S. Department of Energy Pittsburgh Energy Technology Center—Baseline Design/Economics for Advanced Fischer Tropsch Technology Contract No. DE-AC22-91 PC90027. Topical Report VI—Natural Gas Fischer Tropsch Case Volume II Plant Design and Aspen Process Simulation Model—by Bechtel Ltd August 1996) to simply separate hydrogen from the unconverted syngas in the FT offgas in a PSA process and recycle separated hydrogen to the inlet of the FT reactors. A drawback of this process is that typically 15% to 20% of the hydrogen is lost with the waste gas. In addition, all of the carbon monoxide in the unconverted syngas leaving the FT reaction system is rejected in a low-pressure fuel gas stream. These drawbacks mean that, in order to achieve the required 2 to 1 ratio of hydrogen to carbon monoxide in the feed to the FT reactor system, it is necessary to design the feed syngas generation system to produce a lower hydrogen to carbon monoxide ratio so that, when fresh syngas product and recycled separated hydrogen are mixed, the resulting ratio of hydrogen and carbon monoxide in the FT reactor feed is approximately 2 to 1.

The production of syngas having a hydrogen to carbon monoxide ratio lower than 2 to 1 is particularly undesirable when using an EHTR coupled to a POX reactor. This example of a disadvantage in prior art processes is discussed in U.S. Ser. No. 10/083,778, which is now abandoned. It has been found, surprisingly, that when this ratio is below 2 to 1, it is necessary to limit the amount of heat transferred in the EHTR because, when all available carbon dioxide is recycled back to the syngas generation process then, in order to make the required hydrogen to carbon monoxide ratio, the additional reforming which takes place in the EHTR using heat from the POX reactor must be limited since the extra heat would produce mainly hydrogen which is not required in excess. When the syngas ratio is 2 to 1, all of the POX heat can be utilised in the EHTR. The product syngas flow is increased and its exit temperature is lower.

In the case of a plant that is converting natural gas to liquids in a remote location, the low pressure vented gas has little value, since it may not be economically attractive to compress it for gas turbine fuel with low value, high pressure natural gas being freely available. It would also have little or no value in a plant without an HER in which the excess heat in the primary syngas is used to produce high pressure steam for power generation. In addition, it cannot be used as feed gas in the plant in which all of the natural gas feed is converted to syngas, such as in an ATR, since this would simply return all of the inerts to the FT process. It could be used as firing gas if part or all of the syngas was made in a steam-methane reformer. In some cases, the offgas might be flared resulting in an increase in the release of carbon dioxide to the atmosphere. This reduces the thermal efficiently of the FT process.

An example of a process for the treatment of offgas from a natural gas conversion process is disclosed in WO-A-02/38699 (Steynberg et al; published on 16 May 2002). In this example, the vapour phase remaining after separation of the aqueous and hydrocarbon fractions of a product stream produced in a Fischer-Tropsch reaction process is separated into two, optionally three, components. The first component contains increased concentrations of hydrogen and carbon monoxide. The second component is enriched with methane. The third component comprises mainly carbon dioxide. In one embodiment of the process, a cryogenic separation is proposed to separate the first and second components, following the prior removal of the third component.

Existing FT reactors have a post-reaction cooling step, followed by removal of condensed water and hydrocarbons. The final reactor vent gas following condensation contains a significant quantity of $C_2$ and higher hydrocarbon compounds that must be removed from the vent gas stream. The current general method of treatment is to cool the vent gas to a low temperature (typically −90° C. to −100° C.) following gas compression. The refrigeration system employed would typically be a cascade refrigeration system such as an ethylene-propane or an ethylene-propylene cascade. Carbon dioxide removal (typically in an amine scrubbing system) and a drying step (usually in a desiccant drier with thermal regeneration) must be carried out prior to the cooling step for hydrocarbon removal. The bulk of the hydrocarbon compounds condense and are produced as a liquefied petroleum gas ("LPG") product.

It is an objective of the present invention to process offgas from an FT reaction system or other syngas conversion processes in order to separate, e.g. valuable uncondensed hydrocarbons together with at least the majority of the hydrogen and carbon monoxide and separate the inert gases, typically nitrogen, argon, methane and helium, which accumulate in the FT reactor loop. An additional objective of the invention is to enable the production of the required 2 to 1 ratio of hydrogen to carbon monoxide in the fresh syngas feed to the FT reactor system. It is a further objective of the invention to separate methane from the offgas in a substantially pure form so that it can be recycled as fresh feed to the syngas production plant with no recycle of other inerts such as nitrogen and argon.

As far as the inventors are aware, a cryogenic separation process has not been used in the past to separate hydrogen from offgas from a FT reactor system. Accordingly, there is provided, in a first aspect of the present invention, a process for producing higher molecular weight hydrocarbon compounds or oxygenates from a gas comprising methane, said process comprising:

generating synthesis gas ("syngas") comprising carbon monoxide and hydrogen by reaction of a gas comprising methane with steam and/or an oxidant gas comprising oxygen;

producing higher molecular weight hydrocarbon compounds or oxygenates in a syngas conversion process;

removing offgas comprising unreacted hydrogen and unreacted carbon monoxide from said syngas conversion process; and separating unreacted hydrogen from said offgas or from a gas derived therefrom to produce separated hydrogen product, wherein unreacted hydrogen is separated in a cryogenic separation process to produce separated hydrogen product that is substantially free of unreacted carbon monoxide and a first cryogenic liquid comprising unreacted carbon monoxide.

The present invention is applicable to synthesis processes requiring hydrogen and carbon monoxide mixtures as feedstock in which recycle of unconverted feedstock takes place leading to a build up of inert impurities.

The hydrocarbon compounds and the oxygenates produced have a greater molecular weight than that of methane. It is the inventors' intention that the separated hydrogen product be substantially free of unreacted carbon monoxide which includes separated hydrogen product being entirely free of or essentially free of unreacted carbon monoxide.

The cryogenic separation process is preferably a liquid methane wash process although cryogenic condensation processes may be used.

One advantage of the present invention over the prior art is that separation of hydrogen from such offgas using a cryogenic separation process is more efficient than hydrogen separation using a PSA process as more hydrogen is recovered and available for recycling. Another advantage is that a methane wash cryogenic separation process is capable of reducing the carbon monoxide content in the separated hydrogen product to below 20 ppm by volume. In addition, the high purity of the separated hydrogen product means that it is also available for other processing steps, such as hydrogenation of higher molecular weight hydrocarbons in which carbon monoxide would be a catalyst poison, without further purification.

Carbon dioxide may be added to the reaction of the gas comprising methane, e.g. natural gas, with steam and/or an oxidant gas comprising oxygen, e.g. oxygen or air, to adjust the ratio of hydrogen to carbon monoxide in the resultant syngas.

About half of the offgas from the syngas conversion system, e.g. the FT reactor(s), may be recycled back to the inlet of the syngas conversion system following compression without further treatment. If an FT reactor system is used, such recycling increases, by about a factor of two, the concentration of light hydrocarbons and inerts in the product gas leaving the final FT reactor which improves the partial pressures of and ease of condensation of hydrocarbons, both in the condensation process down to near ambient temperature and in the low temperature system. It also reduces the volume of gas which must be processed in the separation equipment. The effect of recycling inerts is to require a slightly higher pressure in the FT system to maintain the required partial pressures of hydrogen and carbon monoxide. The proportion of untreated compressed vent gas recycled can be varied depending on the relative economics.

A wide range of hydrocarbon compounds having different molecular weights are produced by an FT process. A wax fraction of these hydrocarbons may be converted to liquid hydrocarbons by hydrogenation or "hydrocracking". Thus, the process may further comprise recycling separated hydrogen product for hydrogenation to convert a fraction, usually a wax fraction, of hydrocarbon product into liquid hydrocarbons. Liquid fractions may also be hydrogenated in this way. The separated hydrogen product may be used directly in the hydrogenation of the hydrocarbon fraction, i.e. without a separate purification step. In addition or alternatively, separated hydrogen product may be recycled for conversion into higher molecular weight hydrocarbon compounds or oxygenates in the syngas conversion system.

Unreacted carbon monoxide may be separated from the first cryogenic liquid or from a cryogenic liquid derived therefrom in a cryogenic distillation column, preferably a carbon monoxide splitter column, to produce separated carbon monoxide product and substantially carbon monoxide-free cryogenic liquid. Separated carbon monoxide product may be recycled for conversion into higher molecular weight hydrocarbon compounds or oxygenates in the syngas conversion system. At least one stream, taken from an intermediate location in the distillation column, may be at least partially condensed by indirect heat exchange against separated carbon monoxide and returned as reflux to the distillation column. The distillation column may be reboiled by indirect heat exchange between separated carbon monoxide and bottoms liquid from the separation column.

Where the first cryogenic liquid further comprises argon, the process may further comprise removing at least one argon-enriched stream from a location in the region of high argon concentration in the cryogenic distillation column. Preferably, the argon-enriched stream is removed from the location of maximum argon concentration. The maximum argon concentration is typically in the range 15 to 30 mol %.

Where the substantially carbon monoxide-free cryogen liquid is substantially pure liquid methane, the process may further comprise recycling a vaporised portion of said substantially pure liquid methane for conversion into syngas.

Where the offgas comprises helium, it will be present in the separated hydrogen product if the separation is effected by a liquid methane wash. Thus, the process may further comprise separating helium from separated hydrogen product using a membrane separation system.

Where the offgas further comprises low molecular weight hydrocarbon compounds, the process may further comprise:

cooling said offgas or a gas derived therefrom to condense said low molecular weight hydrocarbon compounds to produce liquefied petroleum gas ("LPG") and removing said LPG to produce substantially LPG-free offgas;

cooling and at least partially condensing said substantially LPG-free offgas to produce partially condensed substantially LPG-free offgas; and separating unreacted hydrogen from a vapour portion of said partially condensed substantially LPG-free offgas in said cryogenic separation process to produce said separated hydrogen product and said first cryogenic liquid.

Where unreacted hydrogen is present in the first cryogenic liquid, the process may further comprise separating unreacted hydrogen from the first cryogenic liquid or a cryogenic liquid derived therefrom in a further cryogenic separation process to produce separated hydrogen fuel by-product and a second cryogenic liquid comprising unreacted carbon monoxide. The further cryogenic separation process is preferably a liquid methane wash.

Where the offgas further comprises helium and wherein separated hydrogen product is recycled for conversion into higher molecular weight hydrocarbon compounds, the process may further comprise removing a portion of the separated hydrogen product once the concentration of the helium in the separated hydrogen product reaches between from 1 to 20 mol %, typically about 5 mol %. The concentration of helium in natural gas varies depending on the source of the natural gas. Therefore, the portion removed may be adjusted in flowrate so that the helium concentration builds up in the loop to the required concentration.

Where the offgas further comprises nitrogen, the nitrogen will be present in the first cryogenic liquid following the separation of hydrogen. Thus, in a methane wash process, the process may further comprise:

either separating nitrogen from the first cryogenic liquid in a nitrogen rejection column to produce a nitrogen-enriched stream and condensed substantially nitrogen-free cryogenic liquid; and separating unreacted carbon monoxide from the condensed substantially nitrogen-free cryogenic liquid in a carbon monoxide splitter column to produce separated carbon monoxide product and liquid methane;

or separating unreacted carbon monoxide and nitrogen from the first cryogenic liquid in a carbon monoxide splitter column to produce liquid methane and a mixture of separated carbon monoxide product and nitrogen; and separating nitrogen from the mixture in a nitrogen rejection column to produce enriched nitrogen and separated carbon monoxide product.

At least a portion of the enriched nitrogen stream may be used to reflux the nitrogen rejection column. The nitrogen rejection column may be reboiled by indirect heat exchange between separated carbon monoxide and bottoms liquid from the nitrogen rejection column. The carbon monoxide splitter column may be reboiled by indirect heat exchange between separated carbon monoxide and bottoms liquid from the splitter column.

The offgas usually comprises carbon dioxide and water which must be removed before the cryogenic stages of the separations. Furthermore, the process may also comprise:

separating carbon dioxide from the offgas using either physical or chemical adsorption such as RECTISOL™ or an amine scrubbing system;

compressing separated carbon dioxide product to produce compressed separated carbon dioxide product; and recycling compressed separated carbon dioxide product for conversion into synthesis gas. Methane, e.g. from the cryogenic separator, may be added to separated carbon dioxide product before compression to produce a carbon dioxide-methane mixture which is recycled for conversion into synthesis gas. Water could be removed using a known desiccant drier.

Recycled carbon monoxide preferably passes through a multistage carbon monoxide compressor. The recycle system plus compressor provides the heat pumping system which furnishes the heat required in separation column reboilers and the cooling duty required for the separation column overhead condensers or for providing reflux cooling duty. In addition, it compresses the carbon monoxide product to a pressure sufficient to be recycled back to the syngas conversion system, e.g. to the FT reactor inlet. Further, it provides a compressed carbon monoxide stream which can be expanded in an expansion turbine to produce the requisite amount of refrigeration to keep the plant in heat balance. In such embodiments, the process may further comprise:

compressing separated carbon monoxide product to produce compressed carbon monoxide product; and expanding compressed carbon monoxide product to provide refrigeration duty to keep the process in heat balance.

One of the benefits of a methane wash cryogenic separation system is that it allows lower purity oxygen, i.e. oxygen having a purity of below 99 mol %, to be used in the syngas generation system since the extra inerts can be rejected within the cryogenic separation system. Typically, "high purity" oxygen contains around 99.5 mol % oxygen and 0.5 mol % argon. Oxygen can typically be produced at lower oxygen purities. Down to around 97 mol % oxygen the balance of composition will be argon. As the purity drops further nitrogen will be present in the oxygen stream. There is a synergistic relationship between an air separation unit ("ASU") producing low purity oxygen and the cryogenic separation system for offgas recovery since such an ASU can have a significantly increased liquid nitrogen ("LIN") production. This LIN can then be used to replace the refrigeration system requirement in the cryogenic offgas separation system.

The syngas is preferably generated by partially oxidizing natural gas with oxygen and by reforming natural gas with steam and the syngas conversion process is preferably an FT process.

According to a second aspect of the present invention, there is provided apparatus for the production of higher molecular weight hydrocarbon compounds or oxygenates from a gas comprising methane according to the process of the first aspect of the present invention said apparatus comprising:

a syngas generation system for generating syngas comprising carbon monoxide and hydrogen by reaction of a gas comprising methane with steam and/or an oxidant gas comprising oxygen;

a syngas conversion system for converting syngas into higher molecular weight hydrocarbon compounds or oxygenates and producing offgas comprising unreacted hydrogen and unreacted carbon monoxide; and a cryogenic separation system for separating unreacted hydrogen from said offgas or a gas derived therefrom to produce separated hydrogen product that is substantially free of unreacted carbon monoxide and a first cryogenic liquid comprising unreacted carbon monoxide. The apparatus may be modified to carry out a process having any or all of the features described above in any combination.

The cryogenic separation system is preferably a first liquid methane wash column.

Where the apparatus produces higher molecular weight hydrocarbon compounds, the apparatus may further comprise a hydrogenation system for hydrogenating a wax fraction of said higher molecular weight hydrocarbon compounds using separated hydrogen product to produce liquid hydrocarbon compounds. In such embodiments, the first liquid methane wash column may be specified to produce separated hydrogen product having a carbon monoxide concentration below the level required to prevent poisoning of the hydrogenation catalyst.

The apparatus may further comprise a cryogenic distillation column, e.g. a carbon monoxide splitter column, for separating carbon monoxide from first said cryogenic liquid or from a cryogenic liquid derived therefrom to produce separated carbon monoxide product and substantially carbon monoxide-free cryogenic liquid. The apparatus may further comprise conduit means for feeding separated carbon monoxide product from the cryogenic distillation column to the syngas conversion system.

Additionally, the apparatus may further comprise conduit means for removing an argon-enriched stream from the region of high argon concentration (and consequently low carbon monoxide concentration) in the carbon monoxide splitter column. Preferably, the argon-enriched stream is removed from the location of maximum argon concentration.

Where the substantially carbon monoxide-free cryogenic liquid is substantially pure liquid methane, the apparatus may further comprise conduit means for feeding substantially pure liquid methane from the cryogenic distillation column to the syngas generation system.

Where the offgas further comprises helium, the apparatus may further comprise a membrane separation system for removing helium from separated hydrogen product.

Where unreacted hydrogen is present in the first cryogenic liquid, the apparatus may further comprise a second liquid methane wash column in which unreacted hydrogen is separated from the first cryogenic liquid or a cryogenic liquid derived therefrom to produce separated hydrogen fuel by-product and a second cryogenic liquid comprising unreacted carbon monoxide. Where the offgas further comprises helium and where separated hydrogen product is recycled for conversion into higher molecular weight hydrocarbon compounds or oxygenates, the apparatus may further comprise conduit means for removing a portion of the separated hydrogen product having a helium concentration of between from 1 mol % to 20 mol %, typically about 5 mol %.

The syngas generation system preferably comprises a partial oxidation ("POX") reactor and an enhanced heat transfer reformer ("EHTR") and the syngas conversion system preferably comprises at least one FT reactor.

The apparatus may further comprise an expander for expanding compressed carbon monoxide to provide refrigeration in order to keep the plant in heat balance. Additionally or alternatively, liquid nitrogen could be used to provide at least a portion of any refrigeration duty required to keep the plant in heat balance.

In addition, the apparatus may further comprise a nitrogen rejection column for separating nitrogen from the first cryogenic liquid or from substantially carbon monoxide-free cryogenic liquid.

In addition, the apparatus may further comprise a nitrogen rejection column for separating nitrogen from said cryogenic liquid or from substantially carbon monoxide-free cryogenic liquid.

The apparatus may further comprise a membrane separation system or other means for removing helium from at least a portion of the separated hydrogen.

In preferred embodiments, the apparatus further comprises:

heat exchange means in which said offgas or a gas derived therefrom is cooled by indirect heat exchange against carbon monoxide and, usually, hydrogen, methane and fuel gas products to condense low molecular weight hydrocarbon compounds and produce LPG and substantially LPG-free offgas;

at least one LPG separator in which LPG is separated from substantially LPG-free offgas to produce LPG and substantially LPG-free offgas;

further heat exchange means in which substantially LPG-free offgas is cooled and at least partially condensed by indirect heat exchange to produce at least partially condensed substantially LPG-free offgas; and conduit means for feeding at least partially condensed substantially LPG-free offgas to the cryogenic separation system for separation into separated hydrogen product and the first cryogenic liquid comprising unreacted carbon monoxide.

In these embodiments, the apparatus may additionally comprise:

a separator for separating syngas vapour from condensed substantially LPG-free offgas to produce syngas vapour and condensed syngas-lean LPG-free offgas;

conduit means for feeding syngas vapour from the separator to the cryogenic separation system for separation, preferably by liquid methane reflux, into separated hydrogen product and a first cryogenic liquid comprising carbon monoxide and methane;

a hydrogen rejection column for separating, preferably by liquid methane reflux, hydrogen from condensed syngas-lean LPG-free offgas to produce separated hydrogen fuel by-product and the first cryogenic liquid; and conduit means for feeding first cryogenic liquid as reflux to the hydrogen rejection column.

Throughout the specification, the term "means" in the context of means for carrying out a function is intended to refer to at least one device adapted and/or constructed to carry out that function. In addition, the terms "hydrogen", "oxygen" and "nitrogen" are intended to refer to the appropriate diatomic molecules rather than the atomic elements.

The following is a description, by way of example only and with reference to the accompanying drawings of a presently preferred embodiment of the invention. In the drawings.

In order to evaluate the improvement of a cryogenic separation cycle over a hydrogen PSA separation cycle on the overall performance of a combined syngas/FT plant, comparative computer simulations have been carried out. The syngas generation system comprised a POX reactor combined with an EHTR to produce the desired ratio of hydrogen to carbon monoxide for the FT plant. The hot product syngas from the POX reactor enters the shell side of a steam-natural gas reforming reactor which has catalyst filled tubes open at the hot end. This POX gas mixes with the reformed gas leaving the open ends of the reformer tubes and the mixture is used to provide the heat for the steam-natural gas reforming reactions taking place in the catalyst filled tubes. Recycled and purified hydrogen or hydrogen plus carbon monoxide mixes with "fresh" syngas before being fed to the FT plant. The POX-EHTR system produces a hydrogen to carbon monoxide ratio such that the ratio of hydrogen to carbon monoxide in the FT plant feed is 2.02 to 1.0.

Recycled carbon dioxide from the unconverted gas separation system is used in order to achieve the required hydrogen carbon monoxide ratio. Recycled carbon dioxide is introduced either into the EHTR feed or into the POX effluent stream where reactions occur to give shift equilibrium. This combined stream from the POX reactor and the EHTR then provides the heat of reaction for the reforming reaction within the EHTR tubes.

Figure 1:
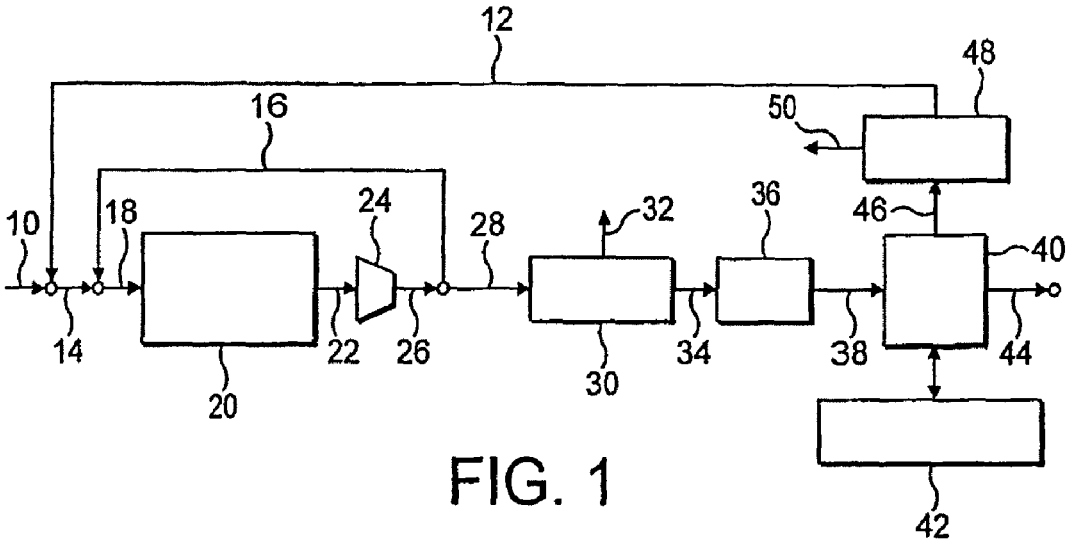
FIG. 1 (PRIOR ART)
FIG. 1 is a general schematic representation of a known offgas separation process.
Figure 2:
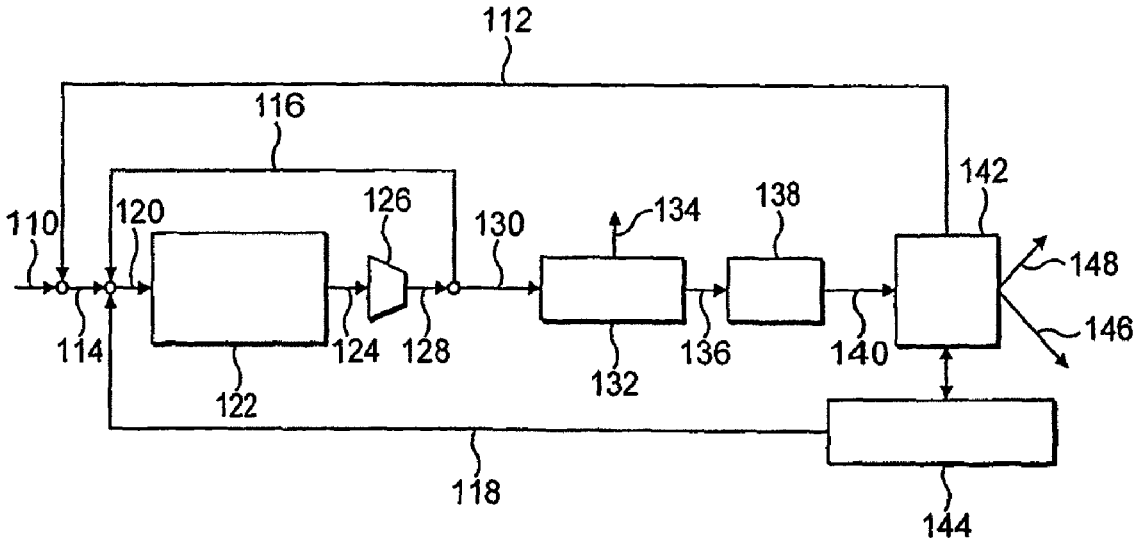
FIG. 2 is a general schematic representation of an embodiment of the present invention.

The two cycles are shown in FIGS. 1 and 2. Referring to the existing process depicted in FIG. 1, a syngas feed stream 10 is combined with a hydrogen stream 12 recycled from a hydrogen separator downstream to form a first combined stream 14. The combined stream 14 is combined with a stream 16 comprising about 50% of the offgas from the FT reactor system 20 to produce a second combined stream 18 which is fed to the FT reactor system 20.

A stream 22 of offgas from the FT reactor system 20 is compressed 24 and the resultant compressed stream 26 is then divided into two substantially equal portions. The first portion 16 is recycled to the feed 10 to the FT reactor system 20. The second portion 28 is fed to an amine scrubbing system 30 for carbon dioxide separation. A stream 32 of carbon dioxide is produced and recycled to the syngas generation system (not shown). A stream 34 of carbon dioxide-free offgas is then dried in a desiccant drier 36 and the resultant dried stream 38 is fed to an LPG removal system 40, the refrigeration duty for which is provided by an ethylene-propane cascade refrigeration system 42. A stream 44 of LPG is removed and a stream 46 of LPG-free offgas is fed to a hydrogen PSA system 48. A stream 12 of separated hydrogen is recycled to the FT reactor feed stream 10 and a stream 50 of low value fuel gas comprising at least hydrogen and carbon monoxide and probably nitrogen, argon and methane is removed.

Referring now to FIG. 2, a syngas feed stream 110 is combined with a hydrogen stream 112 recycled from downstream to produce a first combined stream 114. The first combined stream 114 is then combined with a stream 116 of recycled offgas from the FT reactor system 122 and with a stream 118 of carbon monoxide recycled from downstream to produce a second combined stream 120 which is fed to the FT reactor system 122. A stream 124 of offgas is removed and compressed 126 to produce a compressed stream 128 which is then divided into two substantially equal portions. The first portion 116 is recycled to the FT reactor feed 114 and the second portion 130 is fed to an amine scrubbing system 132 for carbon dioxide removal. A stream 134 of carbon dioxide is removed and recycled to the syngas generation system (not shown). A stream 136 of substantially carbon dioxide-free offgas is dried in a desiccant drier 138 and the resultant dried stream 140 is fed to a coldbox 142 for separation.

Carbon monoxide is separated from the feedgas 140, compressed in a multistage combined recycle and product compressor 144 and recycled as stream 118 to the FT reactor system feed. LPG is removed as stream 146, and nitrogen, argon and methane are removed in a fuel gas stream 148. Separated hydrogen is recycled as stream 112 to the FT reactor feed.

In the case using PSA separation, only hydrogen is recycled and the desired hydrogen to carbon monoxide ratio is obtained by recycling substantially all of the carbon dioxide (not shown) from the FT plant and varying the outlet temperature on the shell side of the EHTR (not shown). In the case using cryogenic gas separation, the outlet temperature from the EHTR (not shown) is fixed to a minimum economic value of 600° C. and the amount of recycled carbon dioxide is varied to obtain the desired hydrogen to carbon monoxide ratio.

The above-mentioned difference in the way the two models are set-up is due to the fact that the syngas production in both cases will necessarily be for different hydrogen to carbon monoxide ratios. When the PSA system is used and only hydrogen is recycled, a lower hydrogen to carbon monoxide ratio will be required from the POX-EHTR combination, i.e. more carbon monoxide must be produced to make-up for the short fall from the separation system. This leads to a situation where the process "runs out" of recycled carbon dioxide. The hydrogen to carbon monoxide ratio can then only be matched by limiting the heat transfer within the EHTR, thereby raising the shell side outlet temperature and wasting heat energy that could be used to produce more syngas.

Where hydrogen and carbon monoxide are both being recycled, the POX-EHTR will be producing syngas having a higher ratio of hydrogen to carbon monoxide, in this case the same as the FT reactor system requirement of 2.02 to 1.0. More than enough carbon dioxide is available for recycling to meet this constraint and so the outlet temperature from the EHTR can be fixed and the amount of recycled carbon dioxide is varied to match the syngas ratio requirement. The heat transfer in the EHTR and the quantity of syngas generated is, therefore, increased in comparison to the known process using PSA separation.

The PSA recycling method has several disadvantages. These disadvantages include the carbon monoxide product being sent to fuel gas rather than being converted to FT liquids. In addition, since hydrogen is being recycled, the hydrogen to carbon monoxide ratio produced by the POX-EHTR combination is lower and the heat removed from the process within the EHTR is lower (since the exit temperature has to be higher), leading to higher steam production. The lower heat duty implies that less of the natural gas feed is going to the EHTR tubes with more going to the POX reactor and thus there is a higher oxygen demand for a given syngas flowrate.

The results for the two cases are shown in Table 1. These results are based on a case for the production of 30,000 bbl/day (4.8 million l/day) of hydrocarbon liquids. The new process is clearly more efficient than the known process. This is evident by the 12.5% reduction in the size of the oxygen plant and 6% reduction in the natural gas feed requirements.

TABLE 1

| | | Hydrogen PSA | Cryogenic Separation System |
|---|---|---|---|
| FT product | bbl/day | 30000.0 | 30000.0 |
| | l/day | 4769610.0 | 4769610.0 |
| | l/s | 55.2 | 55.2 |
| $O_2$ plant size | tonne/day | 4807.5 | 4206.7 |
| | kg/s | 55.6 | 48.7 |
| bbl FT liquid/tonne $O_2$ | | 6.24 | 7.13 |
| liters FT liquid/kg $O_2$ | | 0.99 | 1.13 |
| Total natural gas to | kmol/hr | 12218.8 | 11485.5 |
| syngas generation | Nm3/hr | 273700.1 | 257275.8 |
| Steam to Carbon | EHTR feed | 3.0:1.0 | 3.0:1.0 |
| POX outlet T | ° C. | 1323 | 1323 |
| EHTR outlet T | ° C. | 715 | 600 |
| % FT $CO_2$ recycled | | 100 | 77 |
| $H_2$:CO ratio from POX-EHTR | | 1.87:1.0 | 2.02:1.0 |
| $H_2$:CO ratio to FT plant | | 2.02:1.0 | 2.02:1.0 |

(bbl = US barrels of hydrocarbon liquids)

A significant difference between the two cases appears in the ratio of FT liquids to oxygen required. For the cycle incorporating a PSA system for unconverted syngas purification, 6.24 bbl of FT liquids are produced per tonne of oxygen (0.99 litres of FT liquid per kg of oxygen). This rises to 7.13 bbl per tonne of oxygen (1.13 litres per kg) when both hydrogen and carbon monoxide are being recycled, when the cycle contains a cryogenic gas separation system.

Table 2 shows the typical recoveries of components in the FT offgas for the separation cycles. The number for the PSA case, 80% hydrogen recovery from the PSA, is taken from the Bechtel report (ibid). The numbers obtained for the cryogenic cycle are based on detailed cycle design studies. It may be noted that, although the nitrogen and argon recoveries are only in the range 10% to 50%, these quantities are equal to the nitrogen and argon amounts in the fresh syngas feed to the F-T system. The level of nitrogen and argon has been allowed to rise to an equilibrium value higher than the values in the fresh syngas feed.

TABLE 2

| Component | Hydrogen PSA | Cryogenic Separation System |
|---|---|---|
| $H_2$ | 80% | 90-99% |
| $CH_4$ | 0% | 90-99% |
| CO | 0% | 90-98% |
| $N_2$ | 0% | 10-25% |
| Ar | 0% | 25-50% |

The present invention leads to the recycle of almost all of the hydrogen and carbon monoxide within the unconverted syngas from the FT plant, as opposed to the current technology that recycles only 80% of the hydrogen and none of the carbon monoxide. The present invention therefore minimises the inherent waste in producing carbon monoxide that is then used as fuel or flared rather than being converted to FT liquids. Also, since hydrogen and carbon monoxide are being recycled in approximately the same ratio, the POX-EHTR combination will be producing syngas in the ratio of approximately 2.02 to 1.0 rather than 1.87 to 1.0 when only 80% of the hydrogen is recycled and none of the carbon monoxide. Most of the hydrogen is produced within the EHTR and the carbon monoxide is produced mostly in the POX reactor. Therefore, a higher the hydrogen to carbon monoxide ratio leads to a higher flow of syngas from the EHTR. This means that more of the process heat is recovered within the process and less goes to produce steam. Since less of the total syngas flow, therefore, comes from the POX reactor, less oxygen is required for a given hydrocarbon liquids production.

Figure 3:
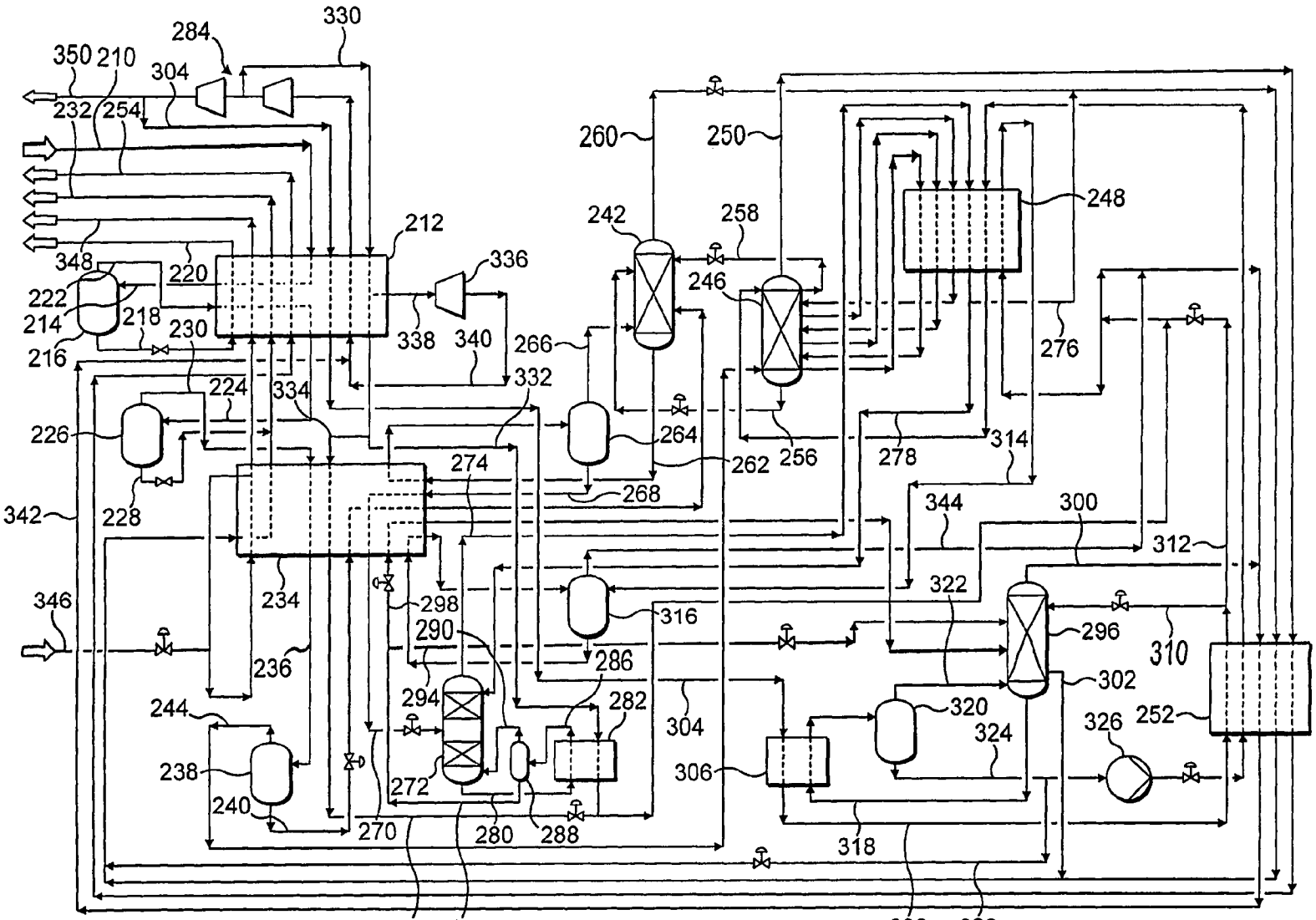
FIG. 3 is a detailed flowsheet of the coldbox for a preferred embodiment of the present invention.

FIG. 3 depicts a detailed flowsheet for the coldbox for a preferred embodiment of the present invention.

Offgas Feed Pre-Treatment (Not Shown)

Unconverted syngas from the FT process following compression and bulk carbon dioxide removal in an amine scrubbing process is fed to a molecular sieve adsorption dryer system. In the dryer system, all traces of carbon dioxide and water are removed prior to entering the coldbox system.

A 2-bed dryer system, operating on the temperature swing principle, is used in which feed gas is passed through the "on-line" bed while the "off-line" bed is regenerated. The bed is regenerated using a dry, heated hydrogen or fuel gas or nitrogen gas from the air separation unit to remove the adsorbed water and carbon dioxide. The regeneration gas passes through the molecular sieve bed and may be cooled in a regeneration gas cooler before passing to the battery limit if necessary.

The molecular sieve switching sequence is automated and has the following sequence of steps:

1.) Adsorption;
2.) Depressurisation to fuel or flare;
3.) Heating;
4.) Cooling;
5.) Repressurisation; and finally
6.) Parallel flow.

The final step in the dryer sequence reduces temperature variations in the feedgas to the coldbox due to co-adsorption of carbon monoxide on the molecular sieve.

Dry, carbon dioxide-free synthesis gas is then introduced to the coldbox.

Hydrogen, Carbon Monoxide and Liquefied Petroleum Gas ("LPG") Production

A stream 210 of dry, carbon dioxide-free offgas from the FT system (not shown) at a pressure of 40 bar is fed to a warm main exchanger 212 and is cooled to −95° C. (−140° F.) and partially condensed against returning process streams to produce a two-phase stream 214. The two-phase stream 214 is then separated in an LPG separator 216 and the liquid stream (LPG) 218 is re-warmed in the warm heat exchanger 212 and removed from the coldbox as a liquid product 220. The vapour stream 222 is then cooled and partially condensed in the warm heat exchanger 212 to produce a second two-phase stream 224 which is separated in an intermediate feed separator 226 where it is separated into a second liquid stream 228 and overhead vapour 230.

The second liquid stream 228, containing trace amounts of heavy hydrocarbon compounds, is let down in pressure, partially vaporised 212 and removed as part of a fuel stream 232. The overhead vapour 230 from the separator 226 is cooled further and partially condensed in a cold heat exchanger 234 to produce a third two-phase stream 236 which is fed to a cold feed separator 238.

A third liquid stream 240 is removed from the cold feed separator 238, let down in pressure and is partially vaporised 234 before being fed to a hydrogen rejection column 242. This partial vaporisation reduces the reboiler duty of the hydrogen rejection column 242 and, as a result, reduces its reflux requirement. Syngas vapour 244 from the cold feed separator 238 is fed directly to the bottom of a methane wash column 246. In this column, the syngas is refluxed with subcooled liquid methane which adsorbs the carbon monoxide from the gas. The heat of adsorption is removed from the column 246 in a side condenser exchanger 248 by boiling liquid carbon monoxide at low pressure (see below).

A hydrogen product stream 250 is taken from the top of the methane wash column 246 and warmed in carbon monoxide/methane subcooler 252 and the warm main exchanger 212 before leaving the coldbox as hydrogen product stream 254. Virtually all of any helium present in the FT offgas will be removed with the hydrogen product stream.

Bottoms liquid 256 from the methane wash column 246, comprising a mixture of carbon monoxide and methane and inerts nitrogen and argon is let down in pressure and is passed to the hydrogen rejection column 242 where residual hydrogen is separated from the liquid carbon monoxide, methane and inerts mixture. The hydrogen rejection column 242 is reboiled against condensing feed in the cold main exchanger 234 and refluxed with a liquid stream 258 taken from the methane wash column 246. The rejected hydrogen leaves the top of the column 242 as a fuel gas stream 260 that also contains a little methane and a small amount of carbon monoxide. The fuel gas stream 260 is let down in pressure and warmed in the carbon monoxide/methane subcooler 252 and the cold main exchanger 234. Fuel gas exits the plant through the warm main heat exchanger 212 at low pressure as stream 232.

A stream 262 of liquid carbon monoxide, methane and inerts from the bottom of the hydrogen rejection column 242 is partially vaporised in the cold main exchanger 234 and the liquid and vapour phases are separated in separator 264. A vapour stream 266 is returned back to the hydrogen rejection column 242 and a liquid stream 268 is subcooled in the cold main heat exchanger 234. The cooled stream 270 is let down in pressure and fed to a nitrogen rejection column 272 where a nitrogen-enriched stream 274 is taken as an overhead product. The stream 274 is partially condensed in heat exchanger 248 against boiling low-pressure carbon monoxide and then split into two portions. A first vapour portion 276 is mixed with low-pressure fuel gas 260 from the hydrogen rejection column 242. A second liquid portion 278 is fed to the top stage of the nitrogen rejection column 272 as reflux. Bottoms liquid 280 from the nitrogen rejection column 272 is partially vaporised in a nitrogen rejection column reboiler 282 against condensing medium pressure carbon monoxide from a multistage carbon monoxide compressor 284. The resultant two-phase stream 286 is separated in a separator 288 and the vapour phase 290 is returned to the nitrogen rejection column 272.

The resultant liquid stream 292 from the bottom of the separator 288 is then split into two streams. The first liquid stream 294 is let down in pressure and passed directly to the top section of a carbon monoxide splitter column 296. The second stream 298 is let down in pressure and partially vaporised in the cold main exchanger 234 before being fed to the bottom section of the carbon monoxide splitter column 296. In the carbon monoxide splitter column 296, methane and argon are separated from carbon monoxide to give carbon monoxide product 300 from the top of the column 296. A vapour side stream 302 is withdrawn from this column at the location of maximum argon concentration. This argon-enriched side stream 302 is mixed with the low-pressure fuel stream 260.

The carbon monoxide splitter column 296 is reboiled by a stream 304 of high pressure carbon monoxide from the carbon monoxide compressor 284. This stream 304 condenses in a column reboiler 306. On leaving the reboiler 306, the high pressure liquid carbon monoxide stream 308 is subcooled in the carbon monoxide/methane subcooler 252 and then split into two portions. A first portion 310 is let down in pressure to provide reflux to the carbon monoxide splitter column 296. The rest is let down in pressure and fed into a standpipe. The second portion 312 partially vaporises in the side condenser exchanger 248 to provide refrigeration to the methane wash column 246. The resultant partially vaporised carbon monoxide stream 314 is fed to a liquid carbon monoxide reservoir 316 which thermosyphons low pressure carbon monoxide through the cold end of the cold main exchanger 234.

Bottoms liquid 318 from the carbon monoxide splitter column 296 is partially vaporised in reboiler 306 and separated in separator 320. The vapour portion 322 is fed back to the carbon monoxide splitter column 296. The liquid portion 324 from separator 320 comprises liquid methane and is pumped using a methane pump 326 and then subcooled in two subcoolers 252, 248 before entering the top of the methane wash column 246. Excess methane is removed upstream of the methane pump 326 as stream 328 and is mixed with the fuel stream 260 in a standpipe.

A medium pressure carbon monoxide stream 330 is removed from the product compressor 284 at an intermediate pressure level. This stream 330 is cooled down in the warm heat exchanger 212. A portion 332 of this stream 330 is then used to reboil the nitrogen rejection column 272 and the remaining portion 334 is condensed in heat exchanger 234. The medium pressure carbon monoxide is then let down in pressure and fed to the inlet of the liquid carbon monoxide reservoir 316 via the side condenser exchanger 248.

Additional refrigeration for the plant, above that provided by pressure reduction of the feed and heat pump carbon monoxide, is provided by an expander 336 which expands part 338 of the medium pressure (or high pressure (not shown)) carbon monoxide stream 330 from the carbon monoxide product compressor 284. The resultant expanded carbon monoxide stream 340 is combined with a low-pressure carbon monoxide stream 342 from the subcooler 252. Carbon monoxide vapour 344 from the liquid carbon monoxide reservoir 316 and carbon monoxide 300 from the top of the carbon monoxide splitter column 296 are combined and warmed in sub-cooler 252, mixed with the expander exhaust stream 340 and then warmed in the main exchanger 212 before entering the suction of the product compressor 284.

Optionally in place of the carbon monoxide expander 336 a stream 346 of liquid nitrogen can be used to provide plant refrigeration. It is vaporised in the main heat exchangers 234, 212 to provide refrigeration duty to keep the plant in heat balance to produce an at least partially vaporised stream 348 of gaseous nitrogen. Compressed carbon monoxide is produced as stream 350 and recycled back to the FT reactor inlet (not shown).

A summary mass balance for the present process is shown in Table 3.

Figure 4:
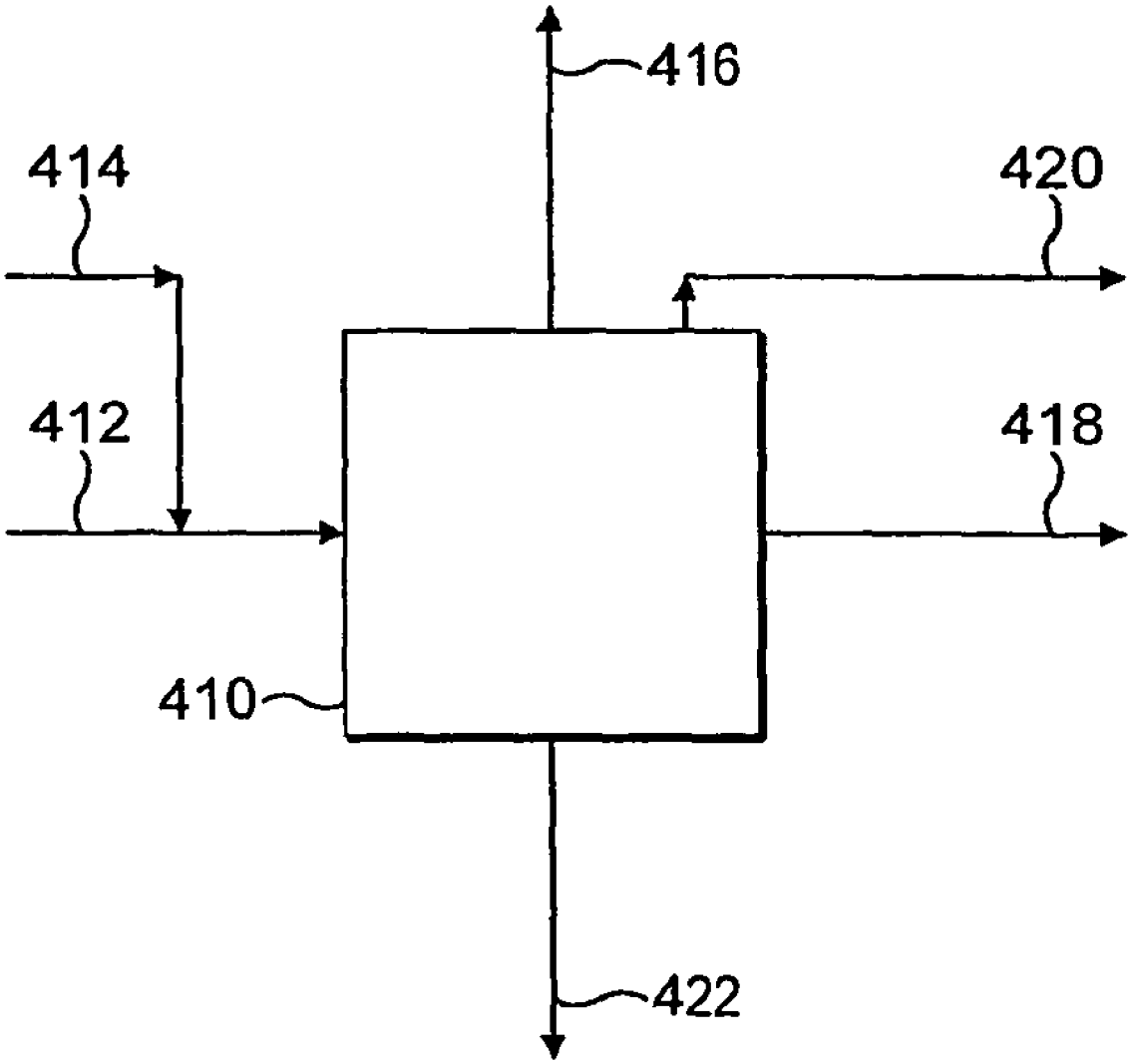
FIG. 4 is a simplified block diagram of the coldbox flowsheet depicted in FIG. 3.

A simplified block diagram of the flowsheet of FIG. 3 is provided in FIG. 4. The feeds to the system 410 are the dried, carbon dioxide-free offgas 412 from the FT process and a hydrogen stream 414 recycled from a hydrocarbon processing section of the FT plant. The product streams include a hydrogen product stream 416, a carbon monoxide product stream 418, a fuel gas stream 420 and an LPG stream 422.

If helium is present in the feed to the present FT offgas separation system, such as might be present in the natural gas fed to the syngas generation system, this helium will concentrate in the hydrogen product stream. In this case, in order to prevent a build-up of helium in the FT system, the helium will be allowed to concentrate to, say, 5% in the hydrogen product from the cryogenic separation system and a portion of this hydrogen product containing helium equal to the flow in the fresh syn-gas feed will be sent to fuel gas. Should it be desirable to recover the helium, or it is required to minimise the losses of hydrogen, then a membrane or other separation system may be used to take this fraction of the hydrogen in which the helium has concentrated to, say, 5%, and preferentially separate the helium from this stream.

TABLE 3

| | | Feedgas from FT Unit | Recycled Hydrogen | CO Product | Hydrogen Product | LPG Stream | Fuel Gas |
|---|---|---|---|---|---|---|---|
| Hydrogen | mol % | 49.47 | 92.53 | 0.00 | 98.72 | 0.66 | 10.74 |
| Carbon Monoxide | mol % | 25.19 | 0.00 | 96.78 | 0.001005 | 2.53 | 2.99 |
| Methane | mol % | 18.17 | 3.05 | 0.00 | 1.22 | 9.43 | 74.37 |
| Nitrogen | mol % | 1.65 | 0.00 | 1.00 | 0.04 | 0.11 | 5.84 |
| Argon | mol % | 1.19 | 0.00 | 2.23 | 0.02 | 0.24 | 2.58 |
| C2+ | mol % | 4.34 | 4.42 | 0.00 | 0.00 | 87.03 | 3.49 |
| Total dry flow | kmol/hr | 4949.8 | 604.7 | 1246.5 | 2919.6 | 231.3 | 1157.2 |
| Pressure | barg | 26.57 | 24.50 | 25.88 | 23.37 | 24.01 | 0.71 |
| | MPa | 2.76 | 2.55 | 2.69 | 2.44 | 2.50 | 0.17 |
| Temperature | ° C. | 37.8 | 37.8 | 37.8 | 33.4 | 33.4 | 33.4 |

Advantages of the present invention include a hydrogen recovery of at least 80% and preferably at least 90%; a carbon monoxide recovery of at least 50% and preferably at least 90%; a concentration of carbon monoxide in the recovered hydrogen of less that 20 ppm and usually around 2 ppm; and the separation of helium and argon from the recycled hydrogen and carbon monoxide.

It will be appreciated that the invention is not restricted to the details described above with reference to the preferred embodiments but that numerous modification and variations can be made without departing from the scope of the invention as defined in the following claims.

The invention claimed is:

1. An apparatus for the production of higher molecular weight hydrocarbon compounds or oxygenates from a gas comprising methane, said apparatus comprising:

a syngas generation system configured to generate syngas comprising carbon monoxide and hydrogen by reaction of the gas comprising methane with steam and an oxidant gas comprising oxygen, wherein heat for endothermic syngas generation is produced by exothermic reaction of the gas comprising methane with the oxidant gas;

a syngas conversion system configured to convert syngas into higher molecular weight hydrocarbon compounds or oxygenates and producing offgas comprising unreacted hydrogen and unreacted carbon monoxide;

a cryogen separation system configured to separate unreacted hydrogen from said offgas or a gas derived therefrom to produce separated hydrogen product that is substantially free of unreacted carbon monoxide and a first cryogenic liquid comprising unreacted carbon monoxide and unreacted hydrogen, the cryogen separation system being a first liquid methane wash column;

a second liquid methane wash column configured to separate unreacted hydrogen from said first cryogenic liquid or a cryogenic liquid derived therefrom to produce separated hydrogen fuel by-product and a second cryogenic liquid comprising unreacted carbon monoxide;

a nitrogen rejection column configured to separate nitrogen from said second cryogenic liquid to produce a third cryogenic liquid;

a cryogenic distillation column configured to separate unreacted carbon monoxide from said third cryogenic liquid to produce separated carbon monoxide product and substantially carbon monoxide-free cryogenic liquid;

a conduit for feeding separated carbon-monoxide product from said cryogenic distillation column to said syngas conversion system; and a conduit located above a bottom of the cryogenic distillation column for removing an argon-enriched sidestream from the cryogenic distillation column.

2. An apparatus as claimed in claim 1, producing higher molecular weight hydrocarbon compounds, said apparatus further comprising a hydrogenation system configured to hydrogenate a fraction of said higher molecular weight hydrocarbon compounds using separated hydrogen product to produce liquid hydrocarbon compounds.

3. An apparatus as claimed in claim 1, wherein said substantially carbon monoxide-free cryogenic liquid is substantially pure liquid methane, said apparatus further comprising conduit means for feeding substantially pure liquid methane from said cryogenic distillation column to said syngas generation system.

4. An apparatus as claimed in claim 1, wherein the offgas further comprises helium, said apparatus further comprising a membrane separation system configured to remove helium from separated hydrogen product.

5. An apparatus as claimed in claim 1, wherein said offgas further comprises helium and wherein separated hydrogen product is recycled for conversion into higher molecular weight hydrocarbon compounds or oxygenates, said apparatus further comprising conduit means for removing a portion of said separated hydrogen product having a concentration of helium between from 1 mol % to 20 mol %.

6. An apparatus as claimed in claim 1, wherein the syngas generation system comprises a partial oxidation ("POX") reactor and an enhanced heat transfer reformer ("EHTR") in which the gas comprising methane reacts with the steam.

7. An apparatus as claimed in claim 1, wherein the syngas conversion system comprises at least one Fischer-Tropsch ("FT") reactor.

* * * * *